US008837756B2

(12) United States Patent
Akino

(10) Patent No.: US 8,837,756 B2
(45) Date of Patent: Sep. 16, 2014

(54) DYNAMIC MICROPHONE UNIT AND DYNAMIC MICROPHONE

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 13/706,533

(22) Filed: Dec. 6, 2012

(65) Prior Publication Data

US 2013/0148836 A1 Jun. 13, 2013

(30) Foreign Application Priority Data

Dec. 8, 2011 (JP) ..... 2011-269078
Mar. 8, 2012 (JP) ..... 2012-051668

(51) Int. Cl.

| | |
|---|---|
| ***H04R 9/08*** | (2006.01) |
| ***H04R 1/04*** | (2006.01) |
| ***H04R 19/04*** | (2006.01) |
| *H04R 9/04* | (2006.01) |

(52) U.S. Cl.

CPC ..... *H04R 19/04* (2013.01); *H04R 9/08* (2013.01); *H04R 1/04* (2013.01); *H04R 9/046* (2013.01); *H04R 2410/03* (2013.01)

USPC ..... 381/177; 381/369; 381/355

(58) Field of Classification Search

USPC ..... 381/94.6, 150, 345–347, 353, 355, 369, 381/177, 396, 400

See application file for complete search history.

(56) References Cited

U.S. PATENT DOCUMENTS

| | | | | |
|---|---|---|---|---|
| 4,427,845 | A * | 1/1984 | Yoshida | 381/94.9 |
| 6,130,952 | A * | 10/2000 | Akino et al. | 381/368 |
| 7,135,638 | B2 * | 11/2006 | Garrett et al. | 84/725 |

FOREIGN PATENT DOCUMENTS

| | | |
|---|---|---|
| JP | 61-30800 | 7/1986 |
| JP | 2009-200869 | 9/2009 |
| JP | 2010-068364 | 3/2010 |

* cited by examiner

*Primary Examiner* — Brian Ensey
*Assistant Examiner* — Sabrina Diaz
(74) *Attorney, Agent, or Firm* — Whitham Curtis Christofferson & Cook, PC

(57) ABSTRACT

A dynamic microphone unit includes: a diaphragm that vibrates in response to received sound waves; a voice coil that is fixed to the diaphragm and vibrates together with the diaphragm; a magnetic circuit that generates a magnetic field in a magnetic gap, the voice coil being disposed in the magnetic gap; a resonator that is disposed adjacent to the obverse of the diaphragm; and a noise canceling coil that is fixed to a surface of the resonator so as to face a position of fixing the voice coil, the surface facing the diaphragm. The noise canceling coil is connected in series with the voice coil and has a winding direction different from that of the voice coil.

7 Claims, 5 Drawing Sheets

DYNAMIC MICROPHONE UNIT AND DYNAMIC MICROPHONE

TECHNICAL FIELD

The present invention relates to a dynamic microphone unit and a dynamic microphone including a coil for reducing noise.

BACKGROUND ART

In a dynamic microphone, a voice coil fixed to a diaphragm is disposed in a magnetic gap defined by magnetic circuit components. In the dynamic microphone, the voice coil vibrates together with the diaphragm in the magnetic gap in response to received sound waves to generate audio signals in response to the vibration velocity due to electromagnetic conversion between the voice coil and a magnetic field. The voice coil then outputs the audio signals. At this time, if the magnetic circuit is affected by some external factor to vary a magnetic flux in the magnetic gap, the voice coil generates signals independent of sound waves. The signals independent of sound waves are noise.

A factor generating noise in the dynamic microphone is, for example, an alternating magnetic field applied to the magnetic circuit. When the alternating magnetic field is generated from a commercial AC power supply, the resulting noise has a relatively low frequency corresponding to the frequency of the commercial AC power. The noise caused by the commercial AC power supply is called hum noise.

Hum noise flows into a microphone through various paths. For example, hum noise is generated by contact of a finger with a switch knob for the switching operation of a microphone. Japanese Unexamined Patent Application Publication No. 2010-68364 discloses a switch knob connected through a metal wire to a shield cover of a switch body. This configuration eliminates electrostatic coupling between the switch knob and a switch contact point to prevent hum noise from occurring at contact of a finger with the switch knob.

Japanese Unexamined Patent Application Publication No. 2009-200869 discloses a narrow-directivity condenser microphone for reducing, for example, hum noise. In more detail, this configuration includes an acoustic tube in electrical contact with a built-in microphone unit through an electrically conductive intermediate disposed therebetween.

Both the above patents disclose condenser microphones for reducing hum noise. In general, dynamic microphones employ electromagnetic conversion as described above and thus generate larger hum noise than condenser microphones.

Dynamic microphones illustrated in FIGS. 4 and 5 are proposed in order to cancel hum noise based on unique configurations utilizing such characteristics of the dynamic microphones. Techniques related thereto will be described below.

FIG. 4 illustrates a unit frame 101 which is a base of a microphone unit. The substantially cylindrical unit frame 101 composed of magnetic material functions as an outer yoke. A disk yoke 102 is fixed in the center hole of the unit frame 101. A disk magnet 103 is fixed above the yoke 102. A disk pole piece 104 is fixed above the magnet 103. The yoke 102, the magnet 103, and the pole piece 104 are bonded to each other. While the unit frame 101 functions as an outer yoke as described above, the yoke 102 functions as an inner yoke.

The outer circumferential surface of the yoke 102 is in close contact with the inner circumferential surface of the unit frame 101. A round gap is provided between the outer circumferential surface of the pole piece 104 and the inner circumferential surface of the unit frame 101. A magnetic circuit is defined by the yoke 102, the unit frame 101, the round gap, and the pole piece 104. A magnetic flux from the magnet 103 returns to the magnet 103 through the magnetic circuit. In this configuration, the round gap functions as a magnetic gap.

A cylindrical member 135 is fixed to the upper outer circumference of the unit frame 101. The cylindrical member 135 has an inward flange 136 at the upper inner circumference. The flange 136 is fixed to the upper outer circumference of the unit frame 101. The flange 136 has multiple through holes 137 in the vertical direction. A cylindrical space between the inner circumferential surface of the cylindrical member 135 and the outer circumferential surface of the unit frame 101 communicates with a space above the cylindrical member 135 through the through holes 137.

The circumference of a diaphragm 105 is fixed to the upper end of the cylindrical member 135. The diaphragm 105 is made by shaping a material such as synthetic resin or metal. The diaphragm 105 includes a center dome and a sub-dome surrounding the center dome. The outer circumference of the sub-dome is fixed to the outer circumference of the cylindrical member 135. The diaphragm 105 can vibrate in response to the sound pressure from received sound waves, in the anteroposterior direction (the vertical direction in FIG. 4) around the outer circumference of the sub-dome as a supporting node.

A voice coil 106 is fixed along the boundary between the center dome and the sub-dome in the diaphragm 105. The voice coil 106 has an air-cored cylindrical shape formed by winding a thin conductive wire, one end of the cylindrical shape being fixed to the diaphragm 105. The voice coil 106 is disposed in the magnetic gap while the outer circumference of the sub-dome in the diaphragm 105 is fixed as described above. The sub-dome in the diaphragm 105 covers the through holes 137 of the cylindrical member 135 from above.

Adjacent to the reverse of the diaphragm 105 (below the diaphragm 105 in FIG. 4), a protector 107 is fixed to the top surface of the pole piece 104. A constant gap is provided between the domal top surface of the protector 107 and the center dome of the diaphragm 105. The protector 107 has a center hole 171 communicating with center holes 141, 131, and 121 of the pole piece 104, the magnet 103, and the yoke 102, respectively.

Adjacent to the obverse of the diaphragm 105, a resonator 108 has an outer circumference fixed to the upper outer circumference of the cylindrical member 135. A constant gap is provided between the central domal ceiling surface of the resonator 108 and the center dome of the diaphragm 105. The resonator 108 has a center hole 181 for introducing external sound waves to the diaphragm 105. The resonator 108 additionally has multiple holes 182 around the center hole 181. A lid 110 is fit to the lower end of the unit frame 101. A lower opening of the unit frame 101 is closed by the lid 110 to define a relatively large air chamber 111.

The diaphragm 105 vibrates in the anteroposterior direction in response to a variation in the sound pressure from received sound waves. The voice coil 106 also vibrates in the anteroposterior direction together with the diaphragm 105. The voice coil 106 vibrates in the magnetic flux passing through the magnetic gap and outputs audio signals in response to the variation in the sound pressure. The dynamic microphone illustrated in FIG. 4 electro-acoustically converts the signals as described above to output the audio signals from both ends of the voice coil 6 to an external device.

The dynamic microphone illustrated in FIG. 4 further includes a noise canceling coil 151 for canceling hum noise flowing thereinto from the exterior. The noise canceling coil 151 is an air-cored coil. The noise canceling coil 151 is fixed so as to be wound on the outer circumferential surface of the resonator 108 fixed to the front end of the cylindrical member 135.

Another example dynamic microphone illustrated in FIG. 5 includes a noise canceling coil 152 fixed to the obverse of a resonator 108. This dynamic microphone has the same configuration as that of the microphone unit illustrated in FIG. 4 except for the arrangement and size of the noise canceling coil 152. The noise canceling coil 152 composed of an air-cored coil has a central axis coaxial with that of the voice coil 106. The noise canceling coil 152 is also provided in order to cancel hum noise flowing from the exterior into the dynamic microphone unit.

The noise canceling coils 151 and 152 illustrated in FIGS. 4 and 5 are connected in series to the voice coil 106 and wound in the direction of canceling hum noise in the voice coil 106 induced by an alternating magnetic field flowing into the microphone.

Next, explanations will be given on undesirable vibratory noise in a dynamic microphone and an example dynamic microphone having a mechanism for eliminating the vibratory noise. In a dynamic microphone, a voice coil has large inertia force due to its large mass and therefore generates vibratory noise in response to mechanical vibration applied from the exterior. In particular, a first-order pressure-gradient microphone employs a mass control for controlling a bidirectional component. A diaphragm is therefore designed so as to have a resonant frequency lower than a main sound acquisition band. As a result, large vibratory noise is generated at the resonant frequency of the diaphragm.

Such vibratory noise can be cancelled by, for example, a dynamic microphone described in Japanese Examined Patent Application No. 61-30800. This patent discloses a vibration detecting device in a microphone case. According to the disclosure, the vibration detecting device detects noise signals outputted from a microphone unit due to mechanical vibration applied from the exterior, converts the detected signal into the opposite phase, and outputs the converted signals. The detected signals with the opposite phase are then added to the output signals of the microphone unit to eliminate the noise signals. The vibration detecting device can be referred to as a vibration pickup. The vibration detecting device includes, for example, a canceling coil in, for example, a microphone unit case and a magnet fixed to the inner surface of a microphone case so as to face the canceling coil, the magnet generating a magnetic field around the canceling coil. The microphone case receives unnecessary external vibration to cause vibration of the microphone unit due to its inertia force relative to the microphone case. This generates electromotive force in the canceling coil. The invention utilizes this electromotive force as signals for canceling the noise signals.

SUMMARY OF INVENTION

Technical Problem

As illustrated in examples of FIGS. 4 and 5, dynamic microphones can reduce hum noise to a certain level by further including noise canceling coils for canceling hum noise flowing thereinto from the exterior. The hum noise cannot however be reduced sufficiently. This is because hum noise cannot be canceled which corresponds to a phase difference between alternating magnetic fields applied to the voice coil 106 and the noise canceling coils 151 and 152.

Additionally, the dynamic microphone described in Japanese Examined Patent Application No. 61-30800 needs a magnet and a detecting coil functioning as a vibration pickup in order to eliminate noise caused by mechanical vibration.

It is an object of the present invention to solve the above problem in conventional techniques, i.e., to provide a dynamic microphone unit and a dynamic microphone that can sufficiently reduce noise.

Solution to Problem

A dynamic microphone unit according to the present invention includes:

a diaphragm that vibrates in response to received sound waves;

a voice coil that is fixed to the diaphragm and vibrates together with the diaphragm;

a magnetic circuit that generates a magnetic field in a magnetic gap, the voice coil being disposed in the magnetic gap;

a resonator that is disposed adjacent to the obverse of the diaphragm; and a noise canceling coil that is fixed to a surface of the resonator so as to face a position of fixing the voice coil, the surface facing the diaphragm.

DESCRIPTION OF EMBODIMENTS

Dynamic microphone units and dynamic microphones according to embodiments of the present invention will now be described with reference to FIGS. 1 to 3.

Embodiment 1

Figure 1:
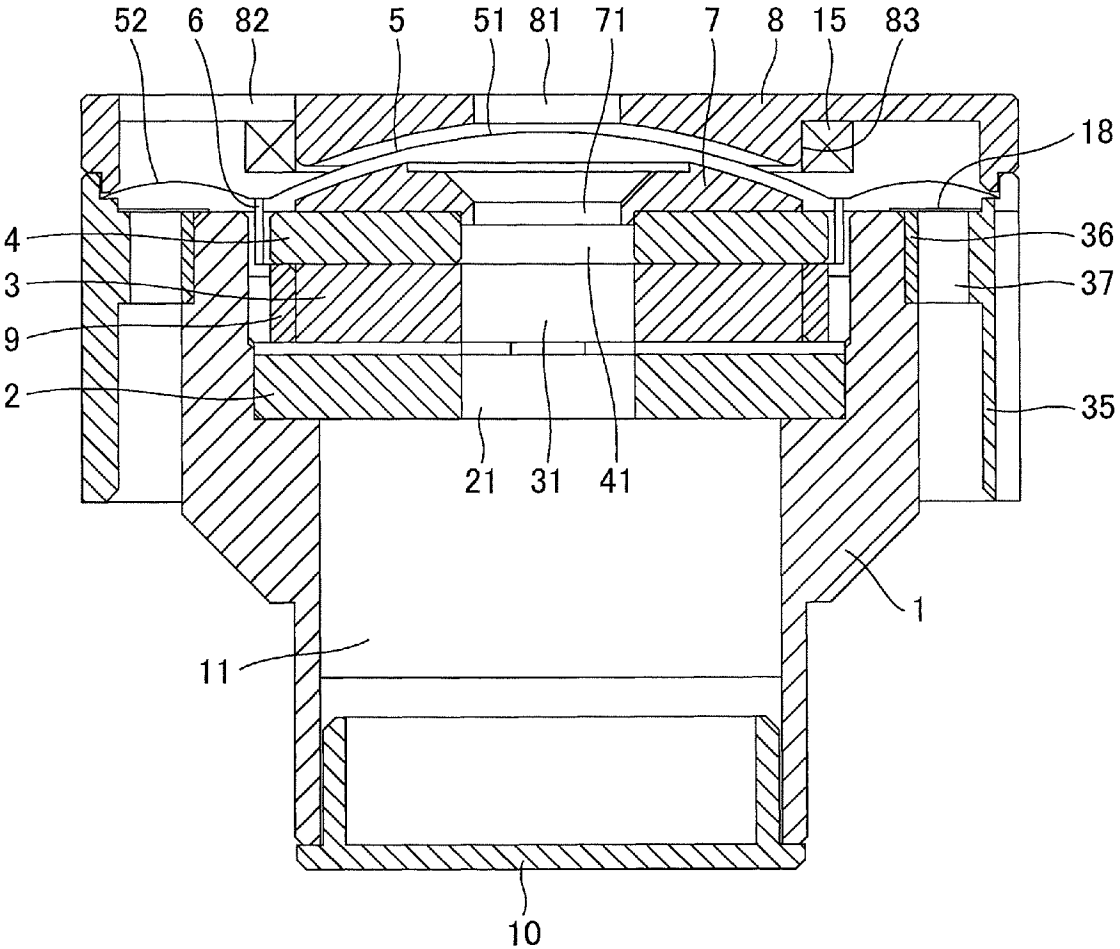
FIG. 1 is a longitudinal cross-sectional view illustrating a microphone unit of use in a dynamic microphone according to an embodiment of the present invention.

FIG. 1 illustrates a unit frame 1 serving as a base of a microphone unit. The unit frame 1 also functions as a part of a magnetic circuit, i.e., an outer yoke. The cylindrical or substantially cylindrical unit frame 1 is composed of magnetic material. As illustrated in FIG. 1, the unit frame 1 has a center hole having a smaller diameter in its substantially lower half and a step portion in its middle in the vertical direction.

In the center hole of the unit frame 1, a disk inner yoke 2 is fixed to the step portion. A disk magnet 3 is fixed above the inner yoke 2. A disk pole piece 4 is fixed above the magnet 3. The inner yoke 2, the magnet 3, and the pole piece 4 have center holes 21, 31, and 41, respectively, having the same diameter. The unit frame 1, the inner yoke 2, the magnet 3, and the pole piece 4 are bonded to each other. In this configuration, the outer circumferential surface of the inner yoke 2 is in close contact with the inner circumferential surface of the unit frame 1. In contrast, a round gap is provided between the outer circumferential surface of the pole piece 4 and the inner circumferential surface of the unit frame 1. A magnetic flux from the magnet 3 returns to the magnet 3 through a magnetic circuit including the yoke 2, the unit frame 1 also functioning as an outer yoke, the gap, and the pole piece 4. In this configuration, the gap functions as a magnetic gap.

A cylindrical member 35 is fixed to the upper outer circumference of the unit frame 1. The cylindrical member 35 has an inward flange 36 at the upper inner circumference. The flange 36 is fixed to the upper outer circumference of the unit frame 1, for example, with an adhesive. The cylindrical member 35 substantially functions as a part of the unit frame 1. The inward flange 36 has multiple through holes 37 in the vertical direction. A cylindrical space between the inner circumferential surface of the cylindrical member 35 and the outer circumferential surface of the unit frame 1 communicates with a space above the cylindrical member 35 through the through holes 37. The through holes 37 have upper ends covered with an acoustic resistor 18.

The circumference of a diaphragm 5 is fixed to the upper end of the cylindrical member 35. The diaphragm 5 is formed by shaping a thin film material such as synthetic resin or metal. The diaphragm 5 includes a center dome 51 and a sub-dome 52 surrounding the center dome 51. The center dome 51 is a partial spherical shell. The sub-dome 52 has an arc-shaped cross section. The sub-dome 52 extends along the circumference of the center dome 51 and is integrated with the center dome 51. The outer circumference of the sub-dome 52 is fixed to the outer circumference of the cylindrical member 35. The diaphragm 5 has the sub-dome 52 having an outer circumference fixed to the cylindrical member 35 as described above and can therefore vibrate in response to the sound pressure from received sound waves, in the anteroposterior direction (the vertical direction in FIG. 1) around the outer circumference of the sub-dome 52 as a supporting node.

A voice coil 6 is fixed along the boundary between the center dome 51 and the sub-dome 52 in the diaphragm 5. The voice coil 6 is formed by winding a thin conductive wire and by fixing it into a cylindrical shape. One end of the cylindrical voice coil 6 is fixed to the diaphragm 5. The voice coil 6 is disposed in the magnetic gap while the outer circumference of the sub-dome 52 in the diaphragm 5 is fixed as described above. The voice coil 6 is separated from both the unit frame 1 and the pole piece 4. The sub-dome 52 of the diaphragm 5 covers the through holes 37 of the cylindrical member 35 and the acoustic resistor 18 from above.

Adjacent to the reverse of the diaphragm 5 (below the diaphragm 5 in FIG. 1), a protector 7 is fixed to the top surface of the pole piece 4. A constant gap is provided between the domal top surface of the protector 7 and the center dome 51 of the diaphragm 5. The protector 7 has a center hole 71 communicating with center holes 41, 31, and 21 of the pole piece 4, the magnet 3, and the yoke 2, respectively.

Adjacent to the obverse of the diaphragm 5 (above the diaphragm 5 in FIG. 1, i.e., on a side for introducing sound waves), a resonator 8 functioning also as a protector for the diaphragm 5 has an outer circumference fixed to the upper outer circumference of the cylindrical member 35. The resonator 8 has a central domal ceiling surface. A constant gap is provided between the resonator 8 and the center dome 51 of the diaphragm 5. The resonator 8 has a center hole 81 for introducing external sound waves to the diaphragm 5. The resonator 8 additionally has multiple holes 82 around the center hole 81. The resonator 8 has the center hole 81 and the multiple holes 82 to thereby define a front acoustic terminal. The resonator 8 enhances the frequency response in a high sound range due to resonance in a front air chamber defined by the inner surface of the resonator 8 and the diaphragm 5.

A lid 10 is airtightly fit to a lower opening of the unit frame 1. This defines a relatively large air chamber 11 in the unit frame 1. The air chamber 11 may contain an acoustic resistor.

The dynamic microphone unit is configured as described above. The dynamic microphone unit is implemented into a microphone case to complete the dynamic microphone. The microphone case has a front side covered with, for example, a front mesh. A connector connected to a microphone cable is implemented on the rear side of the microphone case.

The above-described dynamic microphone unit includes a noise canceling coil 15. The present embodiment is characterized by a manner for implementing the noise canceling coil 15 into the dynamic microphone.

In FIG. 1, the noise canceling coil 15 is an air-cored coil formed by winding a conductive wire into a flattened cylindrical shape. The noise canceling coil 15 is fixed to a surface of the resonator 8 so as to face a position of fixing the voice coil 6, the surface facing the diaphragm 5. The resonator 8 has a convex surface 83 on its surface facing the diaphragm 5, the convex surface 83 being formed by a flattened cylindrical surface along a circle concentric with the voice coil 6. The inner circumferential surface of the noise canceling coil 15 is fit along the convex surface 83 to align and fix the noise canceling coil 15.

The noise canceling coil 15 has the same wound diameter as that of the voice coil 6. In this embodiment, a definition of the noise canceling coil 15 having the same wound diameter as that of the voice coil 6 includes cases of not only completely the same diameter but also substantially the same diameter. The noise canceling coil 15 and the voice coil 6 are overlapped with and away from each other in the central axial direction of the microphone unit. The noise canceling coil 15 is disposed near the voice coil 6 so as not to contact with the voice coil 6 even when the diaphragm 5 vibrates at the maximum amplitude.

The noise canceling coil 15 has the same number of turns as that of the voice coil 6. In this embodiment, a definition of the noise canceling coil 15 having the same number of turns as that of the voice coil 6 includes cases of not only completely the same number of turns but also substantially the same number of turns. In order to mutually cancel noise signals generated in the noise canceling coil 15 and the voice coil 6 by an alternating magnetic field flowing into the microphone unit, the noise canceling coil 15 and the voice coil 6 are configured as described below. The noise canceling coil 15 is connected in series with the voice coil 6. The noise canceling coil 15 has a winding direction opposite to that of the voice coil 6.

An alternating magnetic field flowing into the microphone unit affects the voice coil 6 and the noise canceling coil 15 under substantially the same condition to generate substantially the same noise signals in the coils 6 and 15. According to this configuration, noise signals generated in the voice coil 6 and the noise canceling coil 15 are mutually cancelled to output audio signals having extremely low hum noise, one type of noise signal, from the voice coil 6.

Embodiment 2

A dynamic microphone unit according to a second embodiment of the present invention will now be described. This embodiment can cancel not only hum noise but also noise caused by external mechanical vibration. The description of the second embodiment will focus on different points from the first embodiment.

Figure 2:
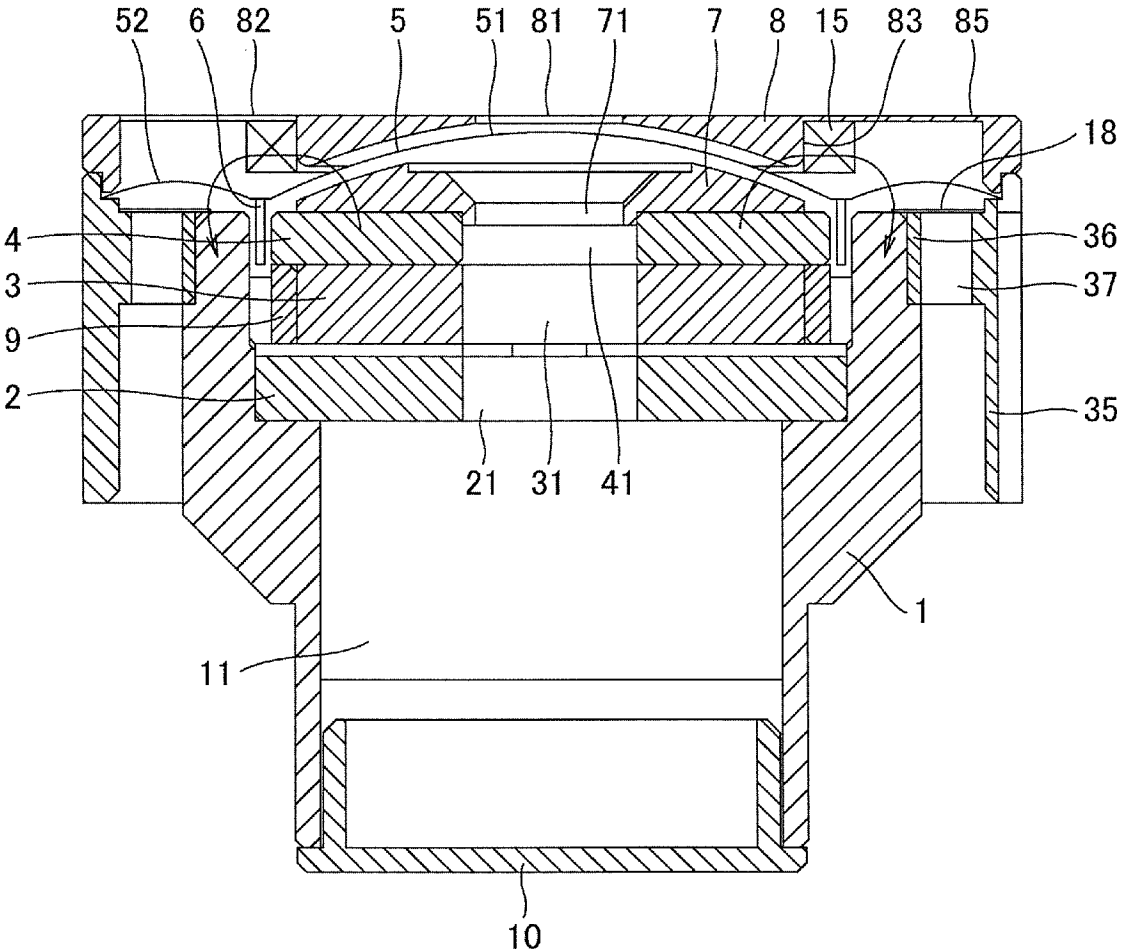
FIG. 2 is a longitudinal cross-sectional view illustrating a microphone unit of use in a dynamic microphone according to another embodiment of the present invention.
Figure 3:
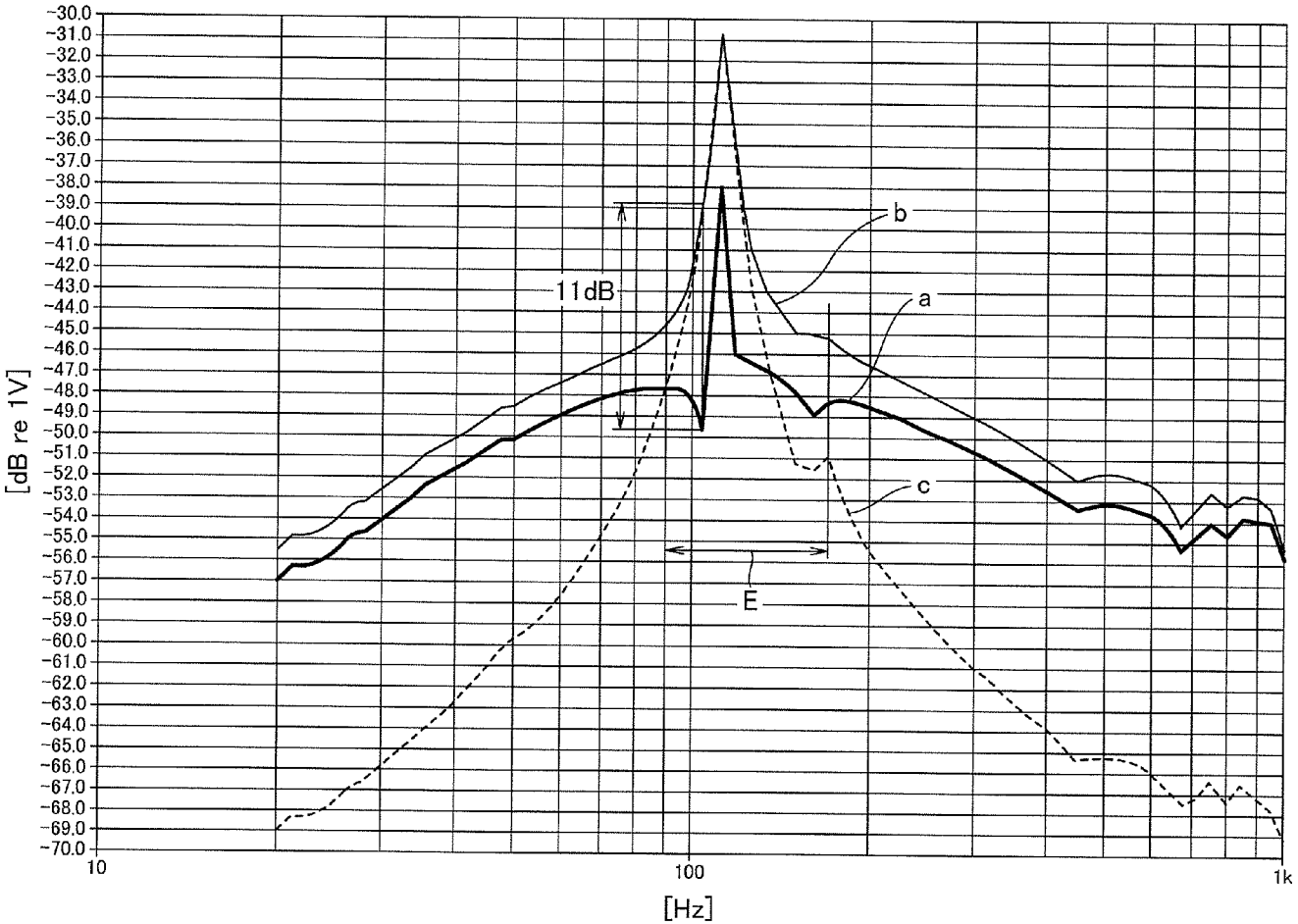
FIG. 3 is a graph illustrating a reduction in vibratory noise achieved by the embodiment illustrated in FIG. 2.
Figure 4:
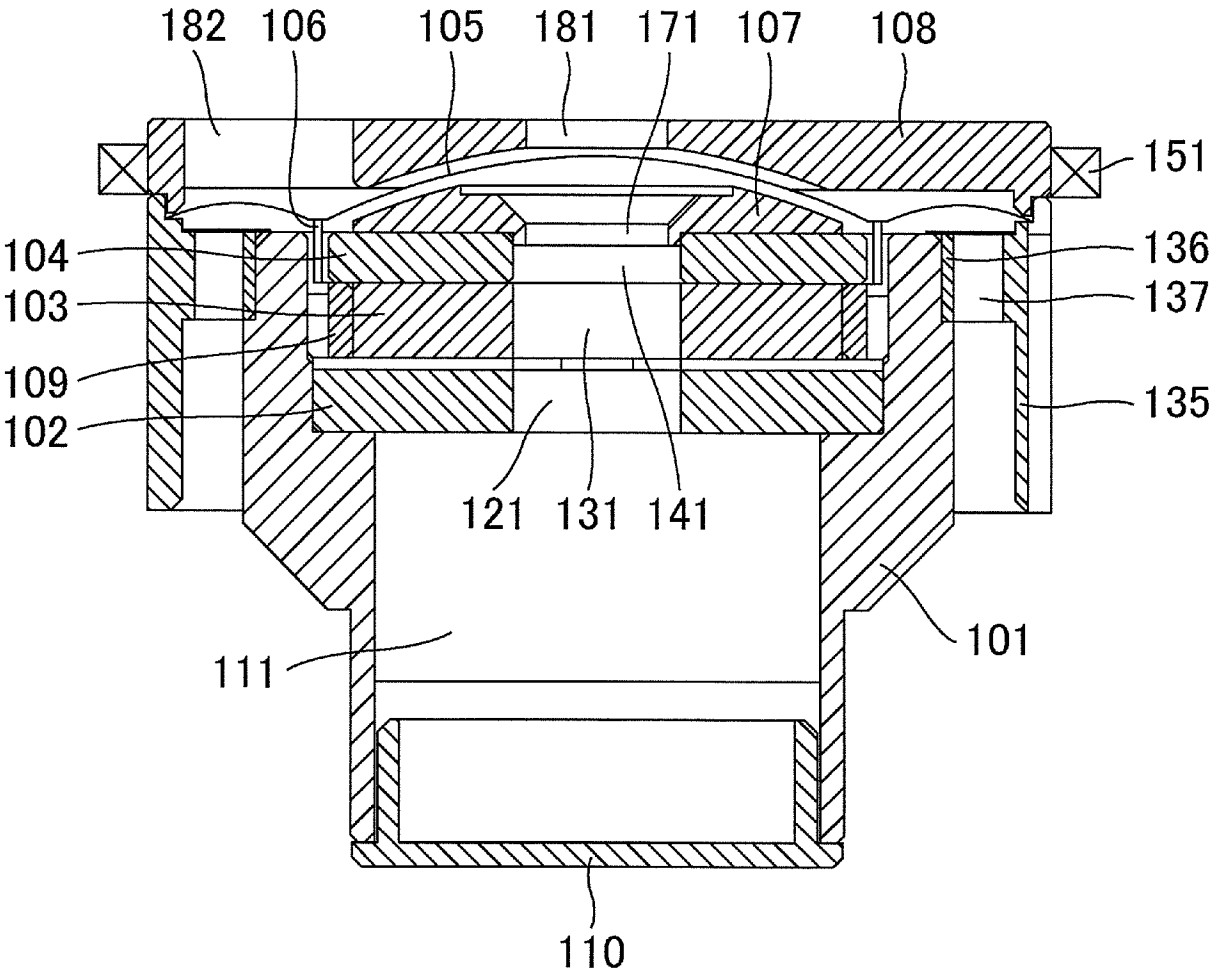
FIG.4 (Related Art)
FIG. 4 is a longitudinal cross-sectional view illustrating an example microphone unit of use in a conventional dynamic microphone.
Figure 5:
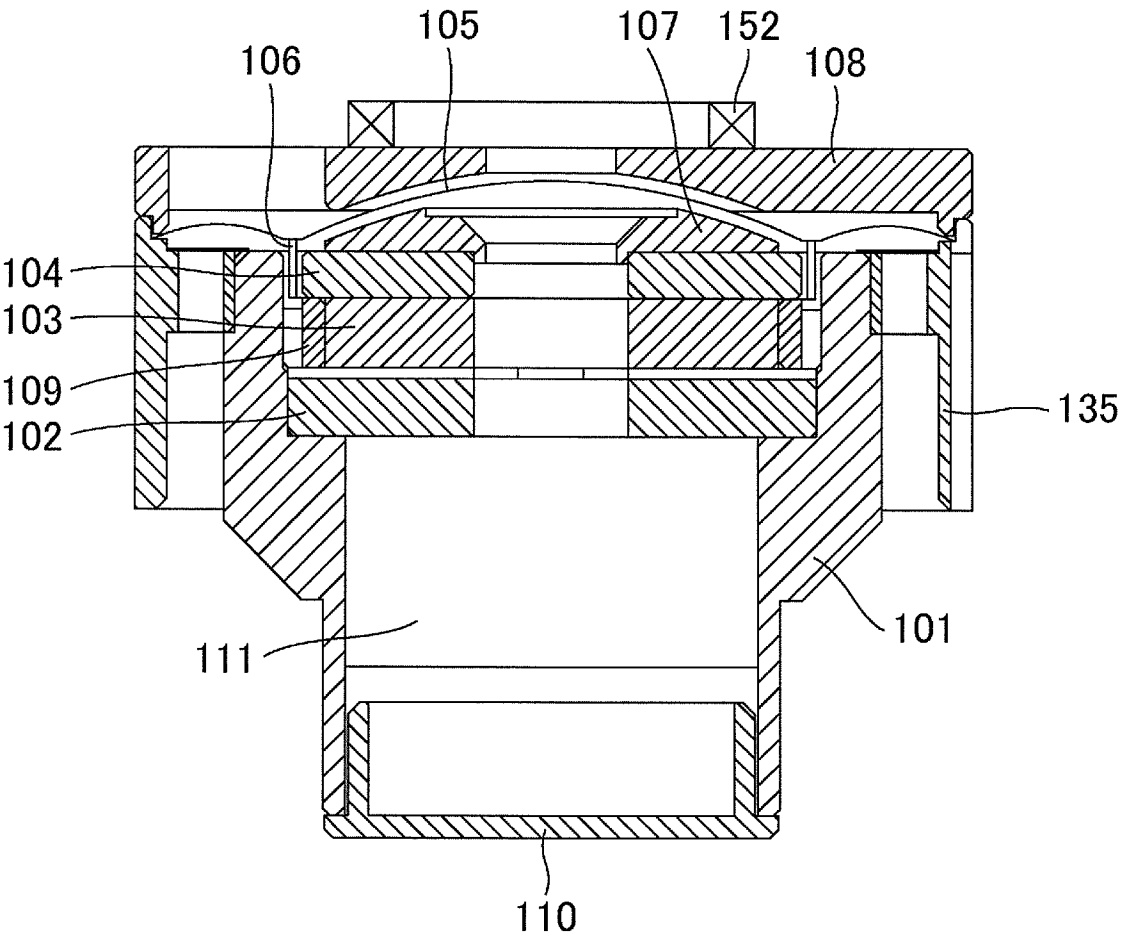
FIG.5 (Related Art)
FIG. 5 is a longitudinal cross-sectional view illustrating another example microphone unit of use in a conventional dynamic microphone.

In FIG. 2, the inner circumferential surface of the noise canceling coil 15 is fit along the outer circumferential surface of the convex surface 83 defined by the cylindrical surface of the resonator 8. This configuration is the same as that of the first embodiment. The resonator 8 has a thin plate connecting portion 85 between its outer circumference and the convex surface 83. According to this configuration, the connecting portion 85 can have resilience so as to vibrate due to vibration applied from the exterior. The noise canceling coil 15 is attached at a position similar to the first embodiment, i.e., at a position so as to face the voice coil 6 across the diaphragm 5. The protector 7 and the resonator 8 are composed of magnetic material. A leakage magnetic flux from a magnetic circuit including the unit frame 1, the inner yoke 2, the magnet 3, and the pole piece 4 passes through the protector 7, the resonator 8, and then the noise canceling coil 15.

Mechanical vibration applied to the microphone unit other than acoustic aerial vibration causes a central portion of the resonator 8 and the noise canceling coil 15 to vibrate due to resilience of the connecting portion 85 in the resonator 8. A resilient coefficient and other design conditions of the connecting portion 85 are determined so as to equalize a resonant frequency of the noise canceling coil 15 due to mechanical external vibration to a resonant frequency of the diaphragm 5. This enables the noise canceling coil 15 to vibrate in the same phase with the diaphragm 5 due to the external vibration.

The noise canceling coil 15 vibrates in the above leakage magnetic flux and thereby generates electricity, i.e., cancel signals in response to the external vibration. As a result, the noise canceling coil 15 functions as a vibration pickup without a dedicated magnetic flux source for picking up vibration. The diaphragm 5 vibrates in response to external vibration to generate vibratory noise from the voice coil 6. The noise canceling coil 15 and the voice coil 6 are electrically connected so as to cancel the vibratory noise with cancel signals outputted from the noise canceling coil 15. The noise canceling coil 15 cancels hum noise similar to the first embodiment. A configuration other than the above is the same as the first embodiment. Descriptions thereon will therefore be omitted.

According to the second embodiment illustrated in FIG. 2 as described above, the noise canceling coil 15 cancels not only hum noise but also noise due to external vibration. In other words, the noise canceling coil 15 substantially constitutes a vibration pickup. As described in Japanese Examined Patent Application No. 61-30800, a vibration pickup inevitably includes components at a microphone case and a microphone unit, for example, a magnet at the microphone case and a coil at the microphone unit. In contrast, the second embodiment of the present invention employs the magnet 3 originally included in the dynamic microphone, as a magnetic flux source necessary for a complete function for the noise canceling coil 15 to cancel vibratory noise. As a result, the second embodiment of the present invention can advantageously not only simplify the configuration for detecting vibration but also provide the vibration pickup within the microphone unit.

Reductions in vibratory noise in the dynamic microphone according to the second embodiment will be described with reference to FIG. 3. In FIG. 3, a horizontal axis represents a frequency [Hz], and a vertical axis represents an output level [dB re 1V] from the voice coil due to mechanical vibration. Graphs were obtained when mechanical vibration was applied from the exterior. A thick solid line "a" indicates an output level after canceling of vibratory noise with output signals from the noise canceling coil 15. A thin solid line "b" indicates an output level before canceling of vibratory noise. A dotted line "c" indicates signals outputted from the noise canceling coil 15 as a vibration pickup due to the mechanical vibration.

As is apparent from comparison between the lines "a" and "b" in the graph, the second embodiment of the present invention reduces vibratory noise by approximately 11 db at a maximum. In FIG. 3, a symbol E indicates a frequency range with a reduction in vibratory noise equal to or more than 3 dB. As is apparent from FIG. 3, the second embodiment extremely reduces vibratory noise.

The dynamic microphone unit according to each embodiment described above can be contained in the microphone case having a microphone connector and other necessary components implemented therein to complete the dynamic microphone.

Any modification can be applied to the dynamic microphone unit and the dynamic microphone according to the present invention without departing from the scope and spirit described in the accompanying claims. For example, the basic configuration of the dynamic microphone unit is not limited to the configurations illustrated in FIGS. 1 and 2. A basic configuration of a conventional dynamic microphone unit may be employed to add thereto the noise canceling coil in the unique configuration according to the present invention.

Advantageous Effects of Invention

In the dynamic microphone described above, an alternating magnetic field flowing into the microphone unit affects the voice coil and the noise canceling coil under substantially the same condition to generate substantially the same noise signals. Additionally, in the dynamic microphone described above, noise signals generated in the voice coil and the noise canceling coil are mutually cancelled to output audio signals having extremely low noise from the voice coil.

What is claimed is:

1. A dynamic microphone unit comprising:

a diaphragm that vibrates in response to received sound waves;

a voice coil that is fixed to the diaphragm and vibrates together with the diaphragm;

a magnetic circuit that generates a magnetic field in a magnetic gap, the voice coil being disposed in the magnetic gap;

a resonator that is disposed adjacent to the obverse of the diaphragm; and a noise canceling coil fixed to a surface of the resonator, the surface facing the diaphragm, the noise cancelling coil facing the voice coil, wherein the resonator has a convex surface positioned on the surface facing the diaphragm, wherein the convex surface is being formed by a flattened cylindrical surface along a circle concentric with the voice coil, and wherein an inner circumferential surface of the noise canceling coil is fit along the convex surface to align and fix the noise canceling coil to the convex surface of the resonator.

2. The dynamic microphone unit according to claim 1, wherein the noise canceling coil is connected in series with the voice coil, and a winding direction of the noise canceling coil being different from a winding direction of the voice coil.

3. The dynamic microphone unit according to claim 1, wherein the noise canceling coil has the same wound diameter as that of the voice coil.

4. The dynamic microphone unit according to claim 1, wherein the noise canceling coil has the same number of turns as that of the voice coil.

5. The dynamic microphone unit according to claim 1, wherein a connecting portion between an outer circumference of the resonator and the position of fixing the noise canceling coil has resilience.

6. The dynamic microphone unit according to claim 1, wherein the noise canceling coil outputs cancel signals in response to mechanical vibration, and the noise canceling coil is connected to the voice coil so as to cancel vibratory noise outputted from the voice coil in response to the mechanical vibration.

7. A dynamic microphone comprising:

a microphone unit; and a microphone case that contains the microphone unit, wherein the microphone unit is a dynamic microphone unit comprising:

a diaphragm that vibrates in response to received sound waves;

a voice coil that is fixed to the diaphragm and vibrates together with the diaphragm;

a magnetic circuit that generates a magnetic field in a magnetic gap, the voice coil being disposed in the magnetic gap;

a resonator that is disposed adjacent to the obverse of the diaphragm; and a noise canceling coil fixed to a surface of the resonator, the surface facing the diaphragm, the noise cancelling coil facing the voice coil, wherein the resonator has a convex surface positioned on the surface facing the diaphragm, wherein the convex surface is being formed by a flattened cylindrical surface along a circle concentric with the voice coil, and wherein an inner circumferential surface of the noise canceling coil is fit along the convex surface to align and fix the noise canceling coil to the convex surface of the resonator.

* * * * *